United States Patent [19]

Winchell

[11] 4,176,755

[45] Dec. 4, 1979

[54] RESEALABLE POUR BOTTLE WITH SEVERING RING

[75] Inventor: David A. Winchell, Twin Lakes, Wis.

[73] Assignee: Baxter Travenol Laboratories, Inc., Deerfield, Ill.

[21] Appl. No.: 6,977

[22] Filed: Jan. 26, 1979

[51] Int. Cl.[2] ..... B65D 1/02

[52] U.S. Cl. ..... 215/32; 215/276

[58] Field of Search ..... 215/32, 252, 276, 250, 215/253; 220/276

[56] References Cited

U.S. PATENT DOCUMENTS

| | | | |
|---|---|---|---|
| 4,093,093 | 6/1978 | Fowles | 215/253 X |
| 4,096,962 | 6/1978 | Riuli | 215/32 |

*Primary Examiner*—Donald F. Norton

*Attorney, Agent, or Firm*—Paul C. Flattery; John P. Kirby, Jr.; George H. Gerstman

[57] ABSTRACT

A resealable container is provided for storing and dispensing liquids. The container is formed in a one-piece molded construction and includes a cap covering an outlet defined by an externally threaded neck, with a frangible section coupling the cap to the neck. An outer ring is threadedly interfitted over the cap in engagement with the neck, with the outer ring having a plurality of inwardly extending slightly flexible fingers which fit around the cap to captivate the cap. The cap is forced downwardly during downward rotation of the outer ring thereby severing the cap from the neck at the frangible section.

5 Claims, 3 Drawing Figures

FIG. 1
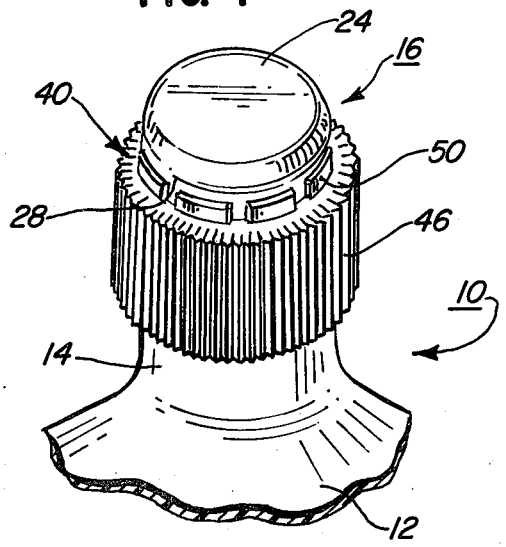
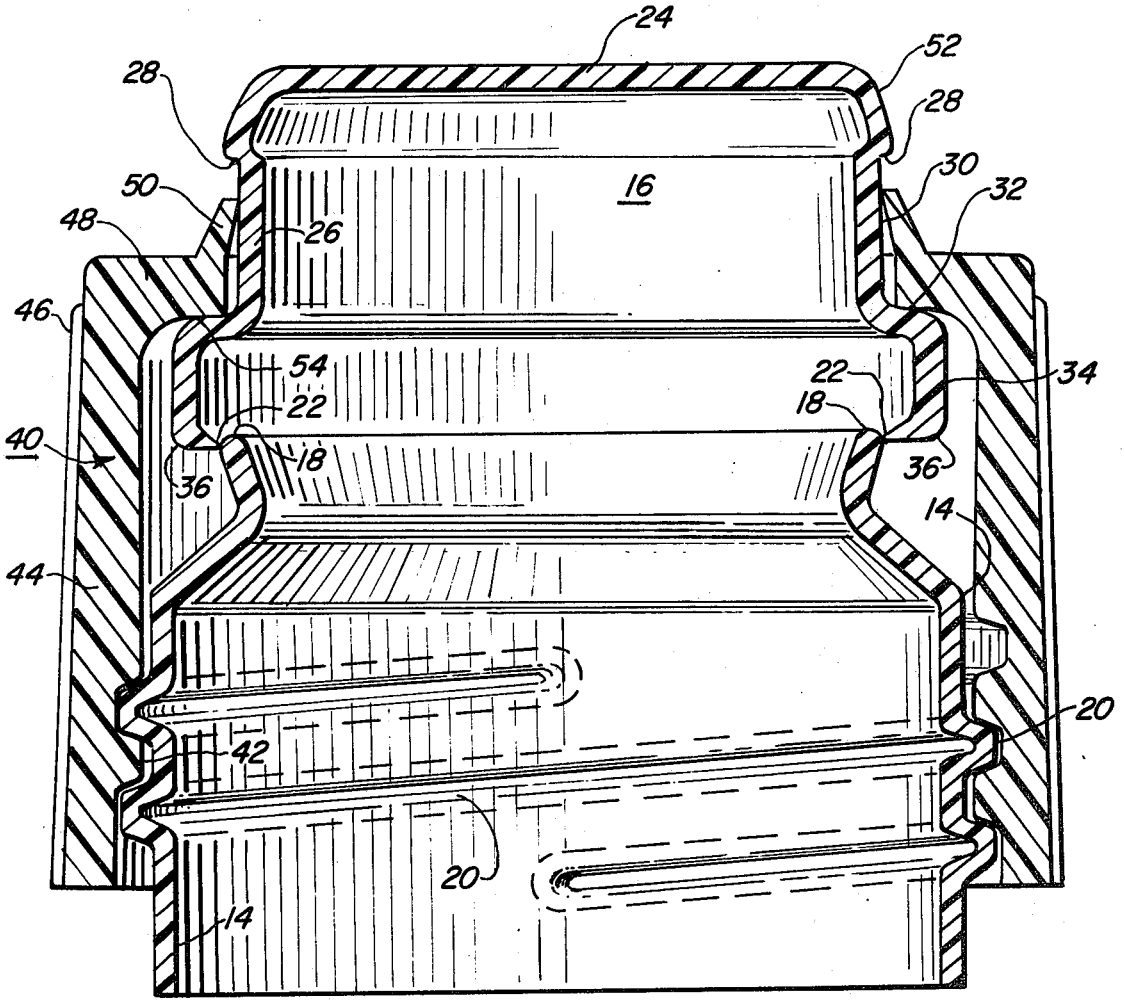
FIG. 2

RESEALABLE POUR BOTTLE WITH SEVERING RING

BACKGROUND OF THE INVENTION

The present invention concerns an improved resealable container for storing and dispensing liquids.

Known in the prior art containers formed in a one-piece molded construction in which the container closure is coupled to the container neck by means of a frangible section. In order to permit removal of the contents from the container, the closure is severed from the neck at the frangible section and the closure is removed.

In certain medical applications, the contents of the container comprise sterile liquids and it is desirable that once the closure is removed from the neck of the container, the closure cannot be resealed with respect thereto. On the other hand, it is often desirable in certain medical and pharmaceutical applications, as well as in other fields, that once the closure is removed from the neck of the container, a portion of the liquid is removed from the container and the closure can then be resealed with respect to the neck. Various types of devices have been proposed in connection with severing the closure from the neck of the container; some of these devices enable the closure to be resealed with respect to the neck, while other devices do not enable resealability.

The various devices proposed for severing the closure from the neck of the container generally take the form of an outer ring which has internal threads that threadly cooperate with the external threads carried by the neck of the container. In one form of severing device, an outer ring carries an inwardly extending flange at its top surface which serves to abut the top of the closure and force the closure downwardly when the outer ring is threaded downwardly, thereby severing the closure from the neck at the frangible section. While this type of severing ring is useful to sever the closure from the neck, after the closure is severed there are three separate pieces—the bottle portion, the closure cap and the severing ring. While the closure cap may be resealed by placing it over the neck and screwing the separate severing ring downwardly thereon, such resealing has been found to be relatively difficult.

Another type of severing device comprises an outer ring having an inwardly extending flange which extends into a recess defined around the closure cap. When the outer ring is screwed downwardly, the closure cap is severed from the neck at the frangible section. It has been found, however, that this type of severing device is relatively difficult to manufacture. Extremely close tolerances are required or else the interference fit between the severing device and the closure cap will create problems. For example, if the diameter of the closure cap is too small, the severing ring will not captivate the cap but will instead operate similarly to the severing ring described above. Further, it has been found that when the severing ring is brought into place, it may break the closure cap off the neck accidently.

Another type of severing device utilizes a plurality of inwardly extending fingers which surrounds the closure cap underneath an outwardly extending flange defined by the closure cap. When the severing ring is rotated upwardly, the severing ring will break the closure cap away from the neck in an upward direction. This type of severing ring does not captivate the cap and does not provide a resealable system.

It is an object of the present invention to provide a resealable container in which the closure cap is captivated by a severing ring that is utilized to sever the closure cap from the neck in a downward direction.

Another object of the present invention is to provide a resealable container that is formed in a one-piece, molded construction and has a severing ring which can be easily engaged with respect to the container without accidently severing the closure cap from the container neck.

Another object of the present invention is to provide a resealable container that is simple in construction and is easy to manufacture.

A further object of the present invention is to provide a resealable medical container for storing and dispensing sterile liquids which utilizes a closure cap that is captivated by means of a severing ring having slightly flexible fingers and which severing ring operates to sever the closure cap from the neck of the container when the severing ring is threaded downwardly with respect to the neck of the container.

Other objects and advantages of the present invention will become apparent as the description proceeds.

SUMMARY OF THE INVENTION

In accordance with the present invention, a resealable container is provided for storing and dispensing liquids. The container includes a neck defining a dispensing outlet and a cap covering the outlet. A frangible section couples the cap to the neck.

The improvement comprises the cap having an outwardly extending retaining abutment and an outwardly extending bearing surface spaced downwardly from the retaining abutment. The neck carries external threads and an outer ring has internal threads for threaded engagement with the external threads of the neck. The outer ring has a plurality of inwardly extending slightly flexible fingers for fitting around the cap intermediate the retaining abutment and bearing surface. In this manner, downward rotation of the outer ring will force the outer ring against the bearing surface thereby severing the cap from the neck at the frangible section. Upward rotation of the outer ring will place the fingers into engagement with the retaining abutment.

In the illustrative embodiment, the neck, cap and frangible section are formed in a one-piece molded construction. The flexible fingers have an internal diameter that is smaller than the external diameter of the retaining abutment but are sufficiently flexible to flex over the retaining abutment when the outer ring is initially threaded downwardly with respect to the neck. In this manner, the fingers will snap into the surface of the cap intermediate the retaining abutment and the bearing surface.

A more detailed explanation of the invention is provided in the following description and claims, and is illustrated in the accompanying drawings.

BRIEF DESCRIPTION OF THE DRAWINGS

FIG. 1 is a fragmentary perspective view of a resealable container constructed in accordance with the principales of the present invention;

FIG. 2 is a cross-sectional elevation thereof, showing the outer ring in position with respect to the container prior to severing of the container cap with respect to the neck of the container.

DETAILED DESCRIPTION OF THE ILLUSTRATIVE EMBODIMENT

Figure 3:
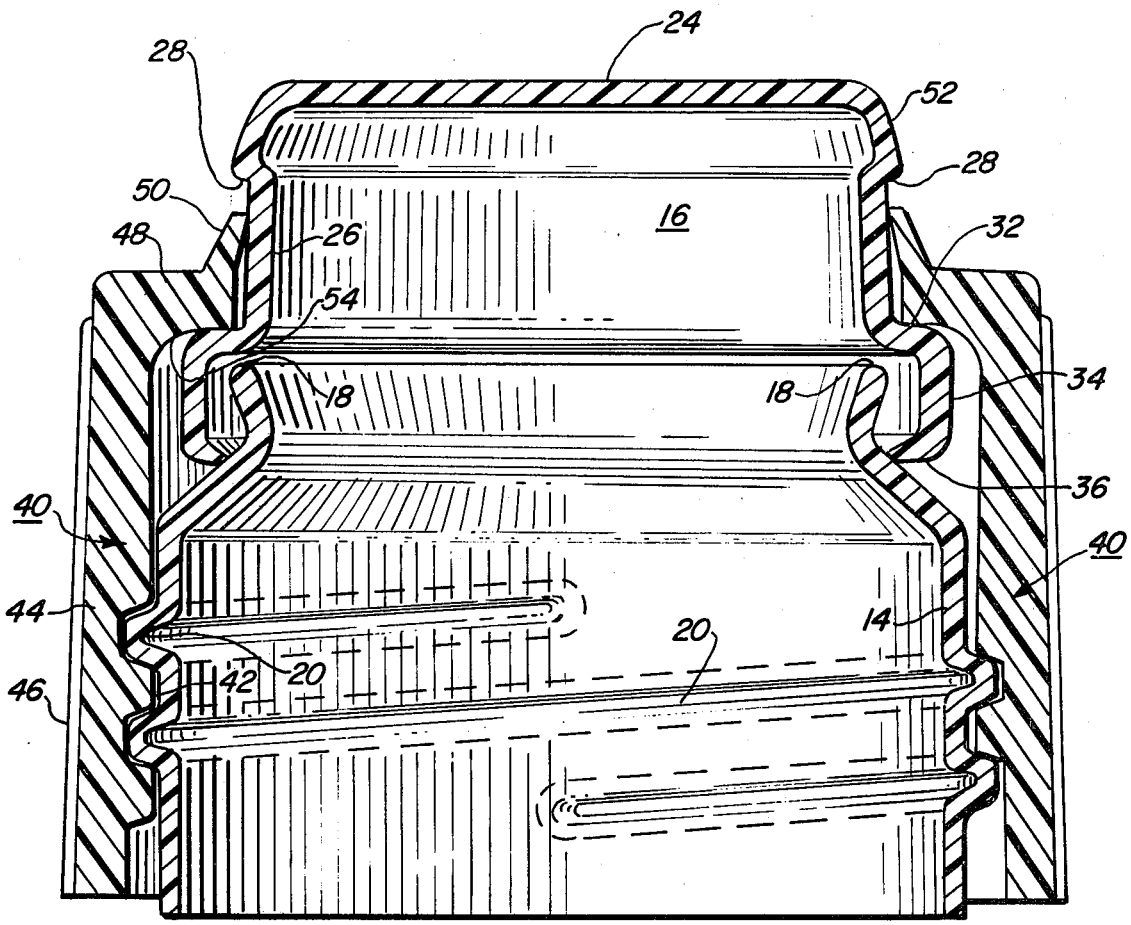
FIG. 3 is a cross-sectional elevation similar to the view of FIG. 2, but showing the cap after it has been severed from the neck of the container.

Referring now to the drawings, there is fragmentarily illustrated a plastic container 10 including a plastic bottle portion 12, a neck 14 extending upwardly from the bottle portion 12 and a closure cap 16 which covers and hermetically seals the dispensing outlet 18 defined by neck 14. Neck 14 carries external threads 20.

Cap closure 16 is coupled to neck 14 by means of a circumferential frangible section 22. Cap 16, frangible section 22, neck 14 and bottle portion 12 are preferably formed in a unitary one-piece blow-molded construction. The plastic material utilized in forming the container is preferably an autoclavable material if the container is intended for use in medical applications, such as for containing sterile liquids including normal saline, sterile water and the like.

The construction of the cap 16 is seen with reference to FIGS. 2 and 3. Cap 16 includes a top portion 24 having a sidewall portion 26 extending downwardly therefrom. Sidewall portion 26 includes an outwardly extending retaining abutment 28 which extends around the entire cap 16 adjacent to top portion 24. A generally vertical main surface portion 30 extends downwardly from retaining abutment 28 and is contiguous with an outwardly extending bearing surface 32 which forms an outwardly extending ledge extending from the bottom of main surface portion 30. A vertical portion 34 extends downwardly from bearing surface 32 and turns inwardly at 36 to meet frangible section 22 which couples cap 16 to dispensing outlet 18 of neck 14.

An outer ring 40 is interfitted with closure cap 16 and is provided with internal left-handed threads 42 which cooperate with external threads 20 of neck 14. Outer ring 40 includes a main sidewall portion 44 which may carry knurling or serrations 46 which assist in holding and turning the outer ring. Outer ring 40 is identical in construction to the outer ring illustrated in U.S. Pat. No. 4,093,093, issued June 6, 1978 and entitled "Antibackoff Closure".

At its top portion, outer ring 40 has an inwardly extending member 48 which carries the plurality of slightly flexible fingers 50 which protrude inward and upward. Fingers 50 fit around main surface portion 30 and once the fingers are placed into position, they remain in such position with respect to the closure cap 16. It is preferred that the flexibility be achieved by forming the outer ring 40 as a one-piece plastic molded construction.

After the container is molded with the liquid contained therein, as is well known in the art, outer ring 40 is threaded downwardly onto neck 14. The fingers 50 define an annular ring having internal diameter that is smaller than the external diameter of retaining abutment 28 and also smaller than the external diameter of bearing surface 32. As the outer ring moves downwardly, the fingers will flex as they move over rounded surface 52 and the fingers 50 will snap into the depression under retaining abutment 28 defined by main surface 30. The container assembly may be purchased by the consumer with the outer ring 40 in the position illustrated in FIG. 2.

When the operator wishes to sever the closure cap 16 from the neck 14 of the container, the outer ring 40 is turned to screw it downwardly with respect to neck 14. The bottom 54 portion 48 will thereby be forced against bearing surface 32 to force the closure cap 16 downwardly and sever the closure cap from the neck as illustrated in FIG. 3. The cap can then be removed by unscrewing the outer ring 40 from neck 14 and the outer ring 40 and closure cap 16 will remain together. In other words, the closure cap 16 has been captivated by the outer ring 14 and such captivation will be maintained throughout use of the assembly.

When it is desired to reseal the outer cap 16 onto the container neck 14, the outer ring 40 is simply threaded onto the neck 14 until the closure cap 16 and neck 14 assume the configuration illustrated in FIG. 3.

It can be seen that an integrally molded one-piece plastic container has been provided which is resealable after the closure has been severed from the neck of the container and which includes a severing ring that captivates the closure cap once the outer ring and closure cap are interfitted. Since the closure is captivated by means of flexible fingers which spring outward when the ring is applied to the closure and snap under a retaining abutment carried by the closure, larger tolerances can be built into both the severing ring and the container without affecting performance. In addition, the present invention greatly reduces the potential of breaking the container open accidently when the ring is applied.

Although an illustrative embodiment of the invention has been shown and described, it is to be understood that various modifications and substitutions may be made by those skilled in the art without departing from the novel spirit and scope of the present invention.

What is claimed is:

1. A resealable container for storing and dispensing liquids, said container including a neck defining a dispensing outlet and a cap covering said outlet, a frangible section coupling said cap to said neck, the improvement comprising:

said cap having an outwardly extending retaining abutment and an outwardly extending bearing surface spaced downwardly from said retaining abutment;

said neck carrying external threads; and an outer ring having internal threads for threaded engagement with the external threads of said neck, said outer ring having a plurality of inwardly extending slightly flexible fingers for fitting around the cap intermediate said retaining abutment and bearing surface, whereby downward rotation of said outer ring will force said outer ring against said bearing surface thereby severing the cap from the neck at the frangible section and upper rotation of said outer ring will place said fingers into engagement with said retaining abutment.

2. A resealable container as described in claim 1, said flexible fingers having an internal diameter that is smaller than the external diameter of said retaining abutment, but are sufficiently flexible to flex over the retaining abutment when the outer ring is initially threaded downwardly with respect to said neck, whereby the fingers will snap into the surface of the cap intermediate the retaining abutment and the bearing surface.

3. A resealable container as described in claim 1, said neck, cap and frangible section being formed in a one-piece molded construction.

4. A reseable container as described in claim 1, said cap including a top portion and downwardly extending sidewall portion, said sidewall portion including said retaining abutment adjacent the top portion, a main surface extending downwardly from said retaining abutment, said bearing surface located below said main surface, and said frangible section located below said bearing surface.

5. A resealable container for storing and dispending liquids, said container including a neck defining a dispensing outlet and a cap covering said outlet, a frangible section coupling said cap to said neck, the improvement comprising:

said cap including a top portion and a downwardly extending sidewall portion, said sidewall portion having an outwardly extending retaining abutment adjacent between the top portion, the main surface extending downwardly from said retaining abutment, and an outwardly extending bearing surface located below said main surface;

said frangible section being located below said outwardly extending bearing surface;

said neck, cap and frangible section being formed in a one-piece molded construction with said neck carrying external threads;

an outer ring having internal threads for threaded engagement with the external threads of said neck;

said outer ring having a plurality of inwardly extending slightly flexible fingers for fitting around the cap on said main surface thereof, said flexible fingers having an internal diameter that is smaller than the external diameter of said retaining abutment, but are sufficiently flexible to flex over the retaining abutment when the outer ring is initially threaded downwardly with respect to said neck, whereby when the outer ring is intially threaded downwardly with respect to said neck the fingers will snap into said main surface and whereby downward rotation of said outer ring will force said outer ring against said bearing surface thereby severing the cap from the neck at the frangible section and upward rotation of said outer ring will place said fingers into engagement with said retaining abutment.

* * * * *